United States Patent [19]

So et al.

[11] Patent Number: 5,036,911

[45] Date of Patent: Aug. 6, 1991

[54] EMBOSSED PLATE OIL COOLER

[75] Inventors: Allen K. So, Mississauga; Charles S. Argyle, Willowdale, both of Canada

[73] Assignee: Long Manufacturing Ltd., Oakville, Canada

[21] Appl. No.: 367,977

[22] Filed: Jun. 19, 1989

[30] Foreign Application Priority Data

Feb. 24, 1989 [CA] Canada ..... 592042

[51] Int. Cl.[5] ..... F28F 3/08; F28F 3/14; F28D 1/02

[52] U.S. Cl. ..... 165/153; 165/140; 165/170; 165/916; 184/104.3

[58] Field of Search ..... 165/151, 152, 153, 170, 165/916, 140; 184/104.3

[56] References Cited

U.S. PATENT DOCUMENTS

| | | | |
|---|---|---|---|
| 1,690,501 | 11/1928 | Potts | 165/38 |
| 3,250,325 | 5/1966 | Rhodes et al. | 165/153 |
| 3,757,856 | 9/1973 | Kun | 165/152 |
| 4,081,025 | 3/1978 | Donaldson | 165/153 |
| 4,470,455 | 9/1984 | Sacca | 165/153 |
| 4,600,053 | 7/1986 | Patel et al. | 165/153 |
| 4,700,774 | 10/1987 | Schwarz | 165/140 |
| 4,800,954 | 1/1989 | Noguchi et al. | 165/153 |

FOREIGN PATENT DOCUMENTS

| | | | |
|---|---|---|---|
| 1501537 | 6/1969 | Fed. Rep. of Germany | 165/153 |
| 3215961 | 11/1983 | Fed. Rep. of Germany | 165/153 |
| 3500571 | 11/1985 | Fed. Rep. of Germany | 165/153 |
| 3544921 | 7/1987 | Fed. Rep. of Germany | 165/153 |
| 0236859 | 9/1987 | Fed. Rep. of Germany | 165/170 |
| 760888 | 3/1934 | France | 165/170 |
| 2494418 | 5/1982 | France | 165/916 |
| 0013994 | 1/1987 | Japan | 165/170 |
| 0026494 | 2/1987 | Japan | 165/151 |
| 0096496 | 4/1988 | Japan | 165/153 |
| 553439 | 5/1977 | U.S.S.R. | 165/153 |
| 490556 | 8/1938 | United Kingdom | 165/152 |
| 977579 | 12/1964 | United Kingdom | 165/140 |

*Primary Examiner*—John Ford

*Attorney, Agent, or Firm*—Krass & Young

[57] ABSTRACT

A plate and fin type heat exchanger is disclosed for cooling automotive engine oil, transmission fluid and power steering fluid. The heat exchanger is formed of a plurality of stacked plate pairs with louvered fins located therebetween. The plate pairs are formed of two elongate identical plates located face-to-face and having planar central portions, raised co-planar peripheral edge portions joined together, and co-planar end bosses with openings therein to form flow headers when the plate pairs are stacked together. The planar central portions have a plurality of uniformly spaced-apart, on-overlapping blunt projections joined together along a common plane with the peripheral edge portions. The projections are symmetrical and provide uniform flow through the plate pairs.

15 Claims, 3 Drawing Sheets

EMBOSSED PLATE OIL COOLER

BACKGROUND OF THE INVENTION

This invention relates to heat exchangers, and in particular, to air cooled exchangers for cooling viscous fluids such as automotive engine oils, transmission fluid and power steering fluid.

In the past, heat exchangers employed for liquid-to-air heat exchange of high viscosity/low thermal conductivity fluids such as engine oil, transmission fluid, transaxle fluids or hydraulic fluids have been commonly produced in three main designs. The first design is an extruded tube and fin design wherein one or more tubular channels is extruded with integral internal fins. A difficulty with this design is that the heat transfer per volume of fluid flowing through the exchanger is usually relatively low, although the flow resistance or pressure drop through the exchanger also tends to be relatively low. There is also a practical limitation as to the depth of the integral internal fins in the tubes that can be extruded and the weight of this type of exchanger is relatively high.

The second common design consists of a bank of extruded or weld-seam tubes with expanded metal turbulizers located inside each tube and exterior cooling fins located between and in contact with the exterior of the tubes. This type of heat exchanger generally exhibits higher heat transfer due to the greater liquid flow turbulization by the turbulizer inside the tubes, however, the flow resistance or pressure drop in the liquid flow through the tubes is undesirably high, and the use of a turbulizer naturally increases the manufacturing costs of the heat exchanger.

The third common design for these liquid-to-air heat exchangers is a plate and fin design in which an expanded metal turbulizer is installed between a pair of mating elongate plates. Again, this type of heat exchanger produces undesirably high liquid flow resistance and the manufacturing cost is high because of the extra steps involved in inserting the turbulizer and the necessity of ensuring that a good bond is achieved between the turbulizer and the plate.

Plate and fin type heat exchangers without turbulizers have been used in other applications, such as automotive air conditioning evaporators. An example of such a device is shown in U.S. Pat. No. 4,470,455 issued Sept. 11, 1984 to DEMETRIO B. SACCA. This patent shows a heat exchanger formed of a plurality of stacked pairs of plates, the plates having rows of overlapping ribs angled obliquely to the flow path. This provides a circuitous or tortuous flow path through the plate pair. While this may be good for the evaporation of refrigerant, it would not be acceptable for high viscosity/low thermal conductivity fluids such as engine oils or hydraulic fluids, because the pressure drop through this type of exchanger would be unacceptably high.

Another example of an automotive air conditioning evaporator using stacked plate pairs without a turbulizer is disclosed in U.S. Pat. No. 4,600,053 issued July 15, 1986 to R. L. PATEL et al. This patent shows a plurality of rows of overlapping dissimilar mating beads said to increase the heat transfer co-efficient of the heat exchanger. Again, however, since this is an air conditioning evaporator for vaporizing refrigerant, flow resistance and pressure drop is not a major concern. This type of heat exchanger could not be used for high viscosity/low thermal conductivity fluids such as engine oils or hydraulic fluids, again because the pressure drop through the exchanger would be unacceptably high, or in other words, the heat transfer efficiency of the exchanger would be unacceptably low. Also, the dissimilar mating beads would not produce sufficient vorticity or turbulence for engine oils and hydraulic fluids.

SUMMARY OF THE INVENTION

The present invention is a plate and fin heat exchanger which achieves a high heat transfer performance-to-liquid side pressure drop ratio and a high heat transfer performance-to-weight ratio through the use of non-overlapping, uniformly spaced-apart mating projections formed in the plates.

According to the invention, there is provided a plate and fin type heat exchanger for cooling viscous fluids comprising a plurality of elongate plates which are laminated together to define a plurality of passageways for movement of viscous fluid therethrough, each plate having a planar central portion and a raised co-planar peripheral edge portion located alternately below and above the plane of the central portion, each intermediate plate having opposed co-planar end bosses located alternately above and below the plane of the central portion, the plates being arranged face-to-face in a plurality of stacked pairs, the bosses having openings formed therein to form respective headers at each end of the plates for flow of fluid through the plate pairs; the central portions having a plurality of projections extending to the plane of the peripheral edge portions, said projections being uniformly spaced-apart both in the longitudinal and transverse directions of the plates, the projections and the peripheral edge portions of each plate pair being joined together, the projections of each plate in a pair being arranged in longitudinal and transverse rows and directly opposite matching projections of the other plate in the pair, the longitudinal rows being spaced-apart to provide longitudinal flow passages between the rows of projections and the transverse rows being spaced in the longitudinal direction so that there is no overlap between rows when they are viewed in the transverse direction of the plates; and corrugated fins located between each plate pair extending between the end bosses and in contact with the respective plate central portions.

BRIEF DESCRIPTION OF THE DRAWINGS

A preferred embodiment of the invention will now be described, by way of example, with reference to the accompanying drawings, in which.

DETAILED DESCRIPTION OF THE PREFERRED EMBODIMENT

Figure 1:
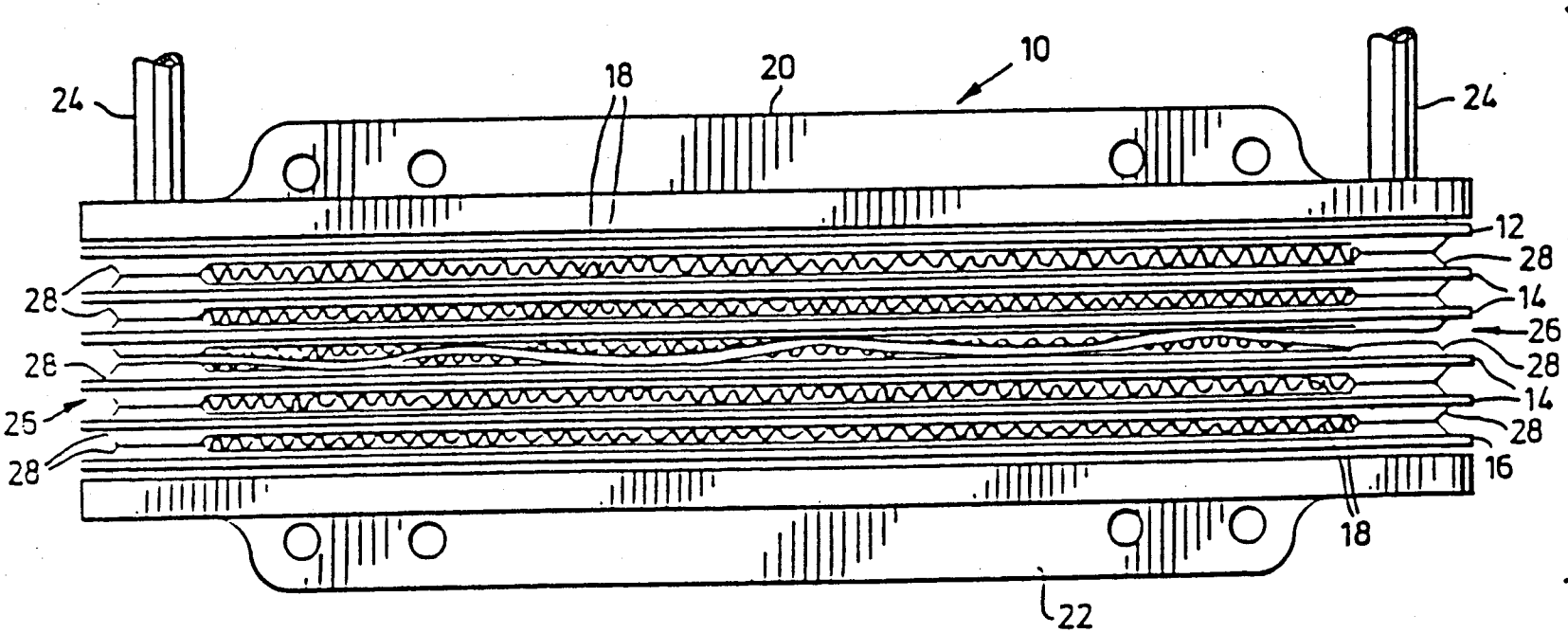
FIG. 1 is an elevational view broken away to indicate indeterminate length of a preferred embodiment of a heat exchanger according to the present invention.

Referring to the drawings, a preferred embodiment of a heat exchanger according to the present invention is generally indicated in FIG. 1 by reference numeral 10. Heat exchanger 10 has a plurality of stacked plate pairs including an upper plate pair 12, a plurality of intermediate plate pairs 14 and a lower plate pair 16. It will be understood that these plates are laminated together to define a plurality of passageways for movement of viscous fluid therethrough. Fin strips 18 are located between the adjacent plate pairs. An upper mounting plate 20 is attached to upper plate pair 12 and a lower mounting plate 22 is attached to lower plate pair 16.

Upper mounting plate 20 includes nipples 24 which communicate with flow headers 26 formed by bosses 28 on each plate pair as will be described further below. One of the nipples 24 acts as a flow inlet and the other nipple 24 acts as a flow outlet. If desired, mounting plates 20, 22 can be eliminated and other inlet and outlet means could be employed for flow of fluid between the headers 26, as will be apparent to those skilled in the art.

Figure 2:
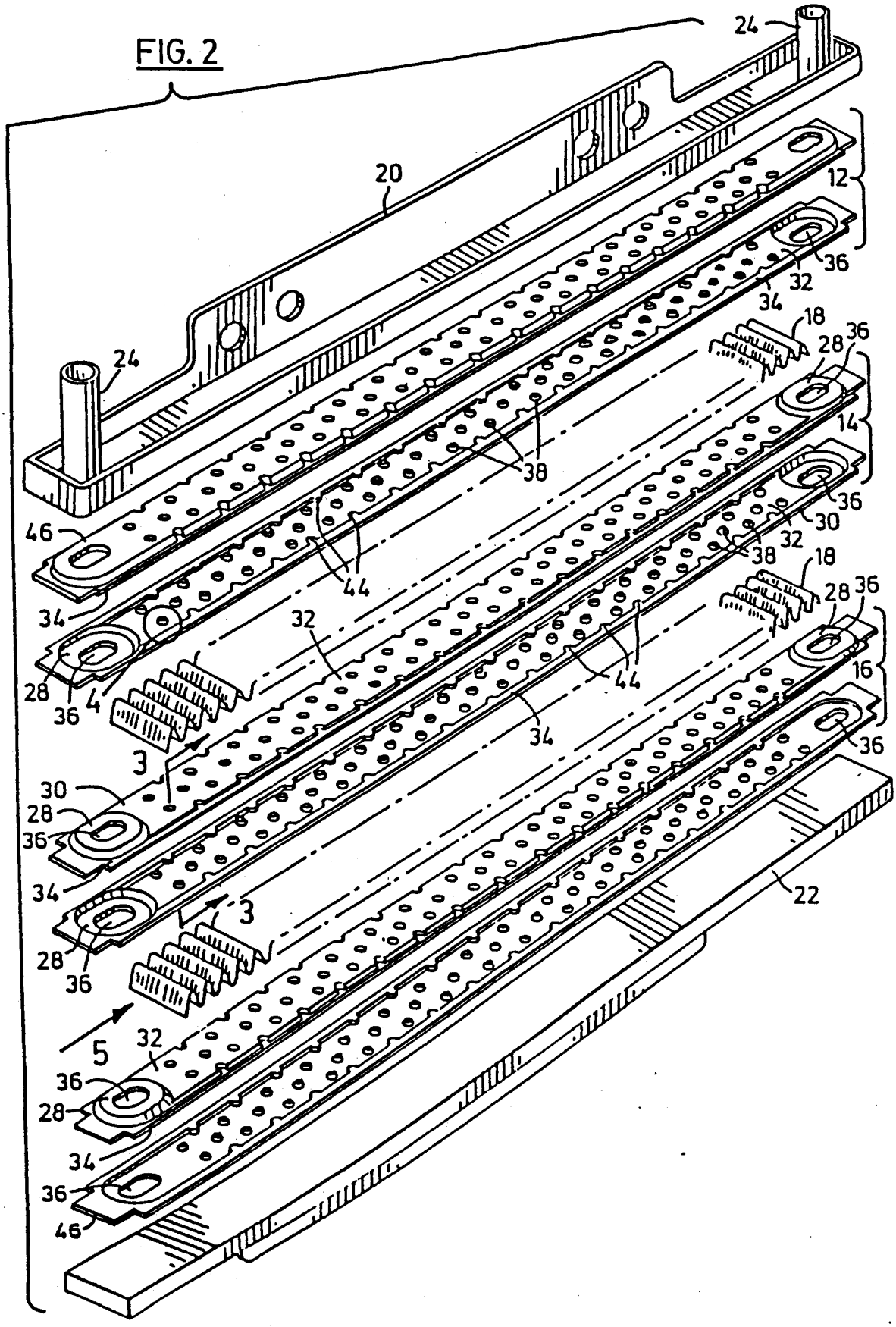
FIG. 2 is an exploded perspective view of the heat exchanger of FIG. 1 showing only three plate pairs for the purposes of simplicity of illustration.
Figure 3:
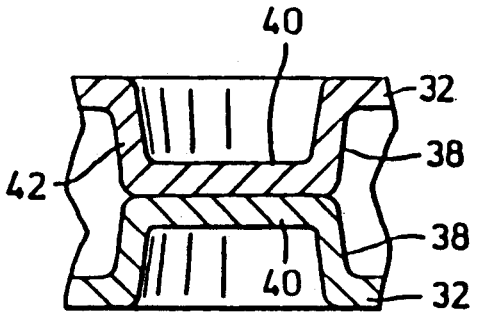
FIG. 3 is a cross sectional view of a pair of mating projections taken along lines 3—3 of FIG. 2.
Figure 4:
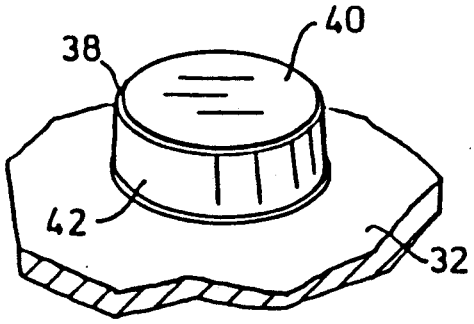
FIG. 4 is a perspective view of a single projection as indicated by circle 4 in FIG. 2.

Referring in particular to FIGS. 2, 3 and 4, an intermediate plate pair 14 (only one of which is shown in FIG. 2 for clarity) includes a pair of identical elongate plates 30 arranged face-to-face. Each plate 30 includes a planar central portion 32, a raised co-planar peripheral edge portion 34 located alternately below and above the plane of central portion 32 and, as mentioned above, opposed, co-planar end bosses 28 located below the plane of central portion 32 when plate 30 is shown face up, and above the plane of central portion 32 when plate 30 is shown face down. Bosses 28 have openings 36 formed therein, so that when a plurality of plate pairs 14 are stacked vertically, the bosses at respective ends of the plate pairs form respective headers 26 (see FIG. 1) for parallel flow of fluid through the plate pairs.

Referring in particular to FIGS. 3 and 4, the planar central portions 32 are formed with a plurality of projections 38, which extend inwardly to the plane of the peripheral edge portions 34. These projections are uniformly spaced apart both in the longitudinal direction and in the transverse direction of the plates. The projections 38 and the peripheral edge portions 34 are joined together when the plate pairs are assembled. Projections 38 have generally flat tops 40 and vertical side walls 42, so that the mating projections 38 form symmetrical blunt-sided flow restrictions inside the plate pairs. Although the term "vertical" is used in association with vertical sides 42, it will be appreciated that some angle is required to suit the draw and tool requirements for forming plates 30. However, the angle from the vertical of sides 40 should not exceed 10 degrees. Also, some slight rounding of flat tops 40 may occur during manufacture of plates 30 depending upon the thickness of the material used to form the plates. For the purposes of this disclosure, the terms "vertical sides" and "flat tops" are intended to include respectively, some angle to the vertical and some rounding as mentioned above. Projections 38 are formed in central plate portions 32 by an embossing process.

As seen best in FIG. 2, projections 38 of each plate in a fair are located in longitudinal rows and directly opposite matching projections of the other plate in the pair. The projections are spaced apart or at least juxtaposed in the longitudinal direction so that there is no overlap when they are viewed in the transverse direction of the plates. The longitudinal rows are spaced apart to provide substantially straight, line of sight longitudinal flow passages between the rows of projections. Projections 38 are circular in plan view and are spaced apart such that adjacent projections are located in a diamond pattern, any three adjacent projections being located at the apexes of an equilateral triangle.

At the peripheral edges of central portions 32, half projections 44, that are generally one half the size in plan view of the remaining projections, are formed along the longitudinal sides of the central portions 32 and adjacent the peripheral edge portions 34. These half projections preferably are integral extensions of the edge portions. Half projections 44 are spaced equidistant from the adjacent full projections 38 in planar central portions 32, again maintaining the equilateral triangle spacing relationship mentioned above.

As the number of projections 38, 44 increases, thereby decreasing the spacing between the projections, the thermal resistance of plates 30 decreases, or in other words, the heat transfer efficiency or performance increases. However, increasing the number of projections and decreasing the spacing therebetween also increases the flow resistance or pressure drop through the heat exchanger. In the preferred embodiment, for any given or predetermined pressure drop limit for heat exchanger 10, the number of projections is maximized.

Referring again to FIG. 2, upper plate pair 12 and lower plate pair 16 have elongate plates 46 adjacent to respective mounting plates 20, 22. Plates 46 are identical to plates 30, except that the bosses 28 are eliminated, so that plates 46 fit flush against the mating surfaces of mounting plates 20, 22. Lower mounting plate 22 covers openings 36 in its adjacent plate 46 and thus acts as an end closure to seal this end of the headers. At the upper mounting plate 20 fluid flows downwardly through one nipple 24 into header 26, and then continues to flow in parallel fashion through all of the plate pairs to the opposite header and then exits through the other nipple 24.

Figure 5:
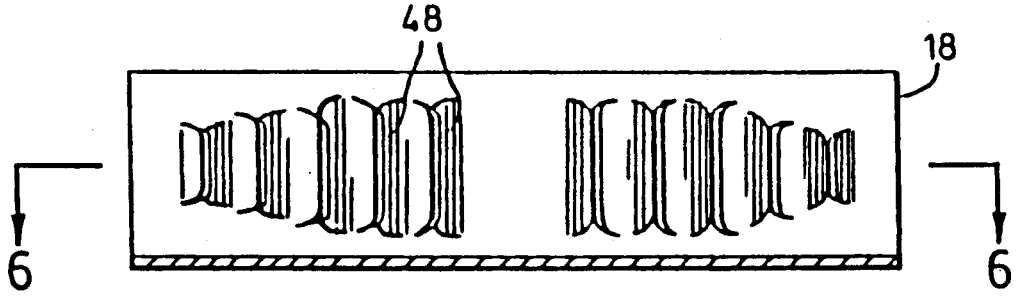
FIG. 5 is an elevational view taken along arrow 5 in FIG. 2 showing one leg of the fin strip.
Figure 6:
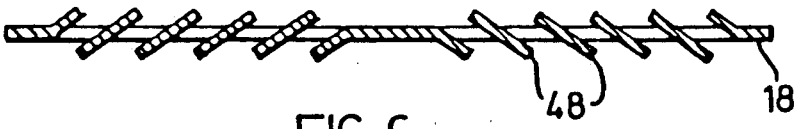
FIG. 6 is a cross sectional view taken along lines 6—6 of FIG. 5.

Referring next to FIGS. 2, 5 and 6, corrugated fin strips 18 are shown having a plurality of transverse louvers 48 formed therein. The length of the louvers 48 extend perpendicularly to the flow of fluid through fins 18. It will be noted that the louvers 48 decrease in length toward the peripheral sides of the fins. This improves heat transfer through the fins where the fins overly the dimples formed in plate central portions 32 by projections 38, 44, by improving transverse heat flow in the fin to the louvres.

The assembly of heat exchanger 10 involves the stacking of plate pairs 12, 14 and 16 with fin strips 18 located therebetween. Mounting plates 20, 22 are then added and the entire assembly is furnace brazed to join all contacting surfaces.

In the preferred embodiment, plates 30, 46 are formed of aluminum with an aluminum brazing alloy cladding or layer formed thereon. Fin strips 18 are formed of plain aluminum and mounting plates 20, 22 are also formed of plain aluminum or any other material that can be brazed to the adjacent plates 46.

In the preferred embodiment, plates 30, 46 are about 28 centimeters in length and 2 centimeters in width and are formed of aluminum sheet material which is about 0.05 centimeters in thickness. Fin strips 18 are formed of any suitable aluminum finning material. Fin strips 18 are typically 2 centimeters in width, 22 centimeters in length and 0.5 centimeters in height.

Having described preferred embodiments of the invention, it will be appreciated that various modifications may be made to the structures described. For example, heat exchanger 10 could be varied in length, width or height. As mentioned above, mounting plates 20, 22 can be eliminated or replaced with other means to direct the liquid flow through the heat exchanger. Also. plate 46 of the lower plate pair 16 can be produced without openings 36 and it may be desirable to do this if there is a potential leak problem. However, it is made this way in the preferred embodiment so that only two types of plates are required to be manufactured to produce heat exhanger 10. Baffling could be incorporated into the heat exchanger to vary the flow path or circuit therein and change the heat transfer and pressure drop characteristics of the heat exchanger to suit particular needs. Other materials could be used for heat exchanger 10, such as stainless steel or brass. Also, the size and spacing of the projections may be varied somewhat in keeping with the parameters discussed above.

For the purposes of this disclosure, the terms "viscous fluid" and "oil" are used interchangeably and are intended to include engine oils, transmission fluids and hydraulic fluids.

From the above, it will be appreciated that the heat exchanger of the present invention is a high performance liquid-to-air heat exchanger that does not require a turbulizer and which is easy to manufacture.

What we claim as our invention is:

1. A plate and fin type heat exchanger for cooling oils, such as engine oil, transmission fluid and hydraulic fluid, comprising:

a plurality of elongate plates which are laminated together to define a plurality of passageways for movement of oil therethrough, each plate having a planar central portion and a raised co-planar peripheral edge portion located alternately below and above the plane of the central portion, each plate having opposed co-planar end bosses located alternately above and below the plane of the central portion, said plates being arranged face-to-face in a plurality of stacked pairs, the bosses having openings formed therein to form respective headers at each end of the plates for flow of oil through the plate pairs;

the central portions having a plurality of projections extending to the plane of the peripheral edge portions, said projections having generally vertical side walls and being uniformly spaced-apart both in the longitudinal and transverse directions of the plates, the projections and the peripheral edge portions of each plate pair being joined together, the projections of each plate in a pair being arranged in longitudinal and transverse rows and directly opposite matching projections of the other plate in the pair, the longitudinal rows being spaced-apart to provide substantially straight, line of sight longitudinal flow passages between the rows of projections and the transverse rows being spaced in the longitudinal direction so that there is no overlap between rows when they are viewed in the transverse direction of the plates whereby the pressure drop of the oil flowing through the heat exchanger is minimized; and corrugated fins located between each plate pair extending between the end bosses and in contact with the respective plate central portions.

2. A plate and fin type heat exchanger as claimed in claim 1 wherein the angle from the vertical of the vertical side walls of the projections does not exceed 10 degrees, so that mating projections form symmetrical blunt-sided flow restrictions.

3. A plate and fin type heat exchanger for cooling oils, such as engine oil, transmission fluid and hydraulic fluid, comprising:

a plurality of elongate plates which are laminated together to define a plurality of passageways for movement of oil therethrough, each plate having a planar central portion and a raised co-planar peripheral edge portion located alternately below and above the plane of the central portion, each plate having opposed co-planar end bosses located alternately above and below the plane of the central portion, said plates being arranged face-to-face in a plurality of stacked pairs, the bosses having openings formed therein to form respective headers at each end of the plates for flow of oil through the plate pairs;

the central portions having a plurality of projections extending to the plane of the peripheral edge portions, said projections being uniformly spaced-apart both in the longitudinal and transverse directions of the plates, the projections and the peripheral edge portions of each plate pair being joined together, the projections of each plate in a pair being arranged in longitudinal and transverse rows and directly opposite matching projections of the other plate in the pair, the longitudinal rows being spaced-apart to provide substantially straight, line of sight longitudinal flow passages between the rows of projections and the transverse rows being spaced in the longitudinal direction so that there is no overlap between rows when they are viewed in the transverse direction of the plates whereby the pressure drop of the oil flowing through the heat exchanger is minimized, and further including half projections, that are generally one-half the size in plan view of the remaining projections, formed along the longitudinal sides of the central portions and adjacent the peripheral edge portions, the half-projections being spaced equidistant from the adjacent projections in the central portions; and corrugated fins located between each plate pair extending between the end bosses and in contact with the respective plate central portions.

4. A plate and fin type heat exchanger as claimed in claim 1 where the majority of projections are circular in plan view.

5. A plate and fin type heat exchanger as claimed in claim 2 where the majority of projections are circular in plan view.

6. A plate and fin type heat exchanger as claimed in claim 1 wherein the projections are arranged in a diamond pattern, any three adjacent projections being located at the apexes of an equilateral triangle.

7. A plate and fin type heat exchanger as claimed in claim 2 wherein the projections are arranged in a diamond pattern, any three adjacent projections being located at the apexes of an equilateral triangle.

8. A plate and fin type heat exchanger as claimed in claim 1 wherein the corrugated fins are formed with transverse louvers, the lengths of which extend perpendicularly to the flow of fluid through the fins.

9. A plate and fin type heat exchanger as claimed in claim 8 wherein the louvers decrease in length toward the peripheral sides of the fins.

10. A plate and fin type heat exchanger as claimed in claim 1 and further comprising mounting plates attached to the upper and lower plate pairs, at least one of the mounting plates acting as an end closure to seal the end of the headers at each end of the plates.

11. A plate and fin type heat exchanger as claimed in claim 2 and further comprising mounting plates attached to the upper and lower plate pairs, at least one of the mounting plates acting as an end closure to seal the end of the headers at each end of the plates.

12. A plate and fin type heat exchanger as claimed in claim 3 and further comprising mounting plates attached to the upper and lower plate pairs, at least one of the mounting plates acting as an end closure to seal the end of the headers at each end of the plates.

13. In an air cooled heat exchange system having a heat exchanging fluid therein, such as engine oil, transmission fluid or hydraulic fluid, a plate and fin type heat exchanger comprising: a plurality of elongate plates which are laminated together to define a plurality of passageways for movement of oil therethrough, each plate having a planar central portion and a raised co-planar peripheral edge portion located alternately below and above the plane of the central portion, each plate having opposed co-planar end bosses located alternately above and below the plane of the central portion, said plates being arranged face-to-face in a plurality of stacked pairs, the bosses having openings formed therein to form respective headers at each end of the plates for flow of oil through the plate pairs;

the central portions having a plurality of projections extending to the plane of the peripheral edge portions, said projections having generally vertical side walls and being uniformly spaced-apart both in the longitudinal and transverse directions of the plates, the projections and the peripheral edge portions of each plate pair being joined together, the projections of each plate in a pair being arranged in longitudinal and transverse rows and directly opposite matching projections of the other plate in the pair, the longitudinal rows being spaced-apart to provide substantially straight, line of sight longitudinal flow passages between the rows of projections and the transverse rows being spaced in the longitudinal direction so that there is no overlap between rows when they are viewed in the transverse direction of the plates; and corrugated fins located between each plate pair extending between the end bosses and in contact with the respective plate central portions.

14. An air cooled heat exchange system according to claim 13, wherein the projections in the central portions have generally vertical side walls at an angle from the vertical less than 10 degrees, so that mating projections form symmetrical blunt-sided flow restrictions.

15. An air cooled heat exchange system according to claim 13 wherein the majority of projections are circular in plan view.

* * * * *